United States Patent [19]

Ikeda

[11] Patent Number: 4,638,819

[45] Date of Patent: Jan. 27, 1987

[54] DEVICE FOR DECREASING SIDE STREAM SMOKE OF TOBACCO PRODUCTS

[75] Inventor: Sakio Ikeda, Nagareyama, Japan

[73] Assignees: Dynic Corporation, Kyoto; Mine Kinzoku Kogyo Kabushiki Kaisha, Yokohama, both of Japan

[21] Appl. No.: 717,704

[22] Filed: Mar. 29, 1985

[30] Foreign Application Priority Data

| | | | |
|---|---|---|---|
| Mar. 30, 1984 | [JP] | Japan | 59-61040 |
| Apr. 17, 1984 | [JP] | Japan | 59-75729 |
| Jul. 4, 1984 | [JP] | Japan | 59-137223 |

[51] Int. Cl.[4] ..... A24F 1/02

[52] U.S. Cl. ..... 131/331; 131/198.1; 131/175; 131/349

[58] Field of Search ..... 131/198.1, 349, 175

[56] References Cited

U.S. PATENT DOCUMENTS

| | | | |
|---|---|---|---|
| 198,075 | 12/1877 | Brisbane | 131/349 |
| 1,770,616 | 7/1930 | Kean | 131/175 |
| 4,446,877 | 5/1984 | Aikman | 131/198.1 |

*Primary Examiner*—V. Millin

*Attorney, Agent, or Firm*—Frishauf, Holtz, Goodman & Woodward

[57] ABSTRACT

For decreasing a side stream smoke generated from a lighted tobacco product, a hollow main body made of non-combustive material and having a through hole is provided to accommodate the product therein. The main body permits continuous combustion of the product but limits the quantity of oxygen supplied to a burning point, thereby preventing generation of the side stream smoke while the lighted tobacco product is not inhaled.

5 Claims, 19 Drawing Figures

FIG. 1A
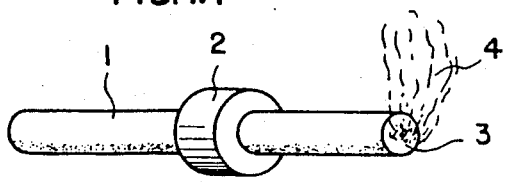
FIG. 1B
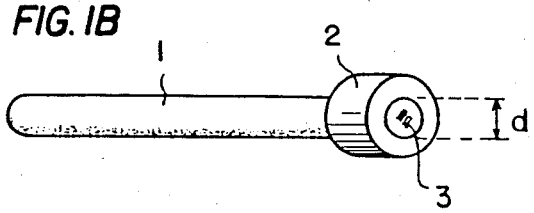
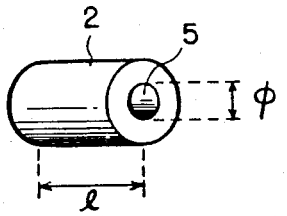
FIG. 2A
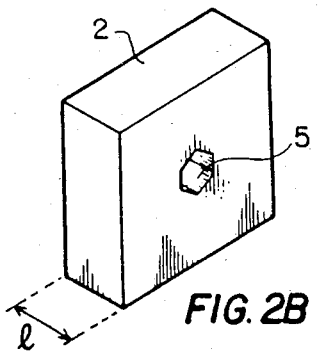
FIG. 2B
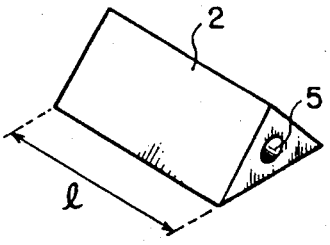
FIG. 2C
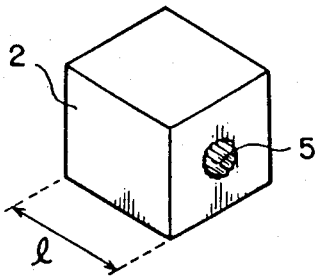
FIG. 2D

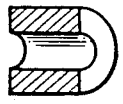
FIG. 3
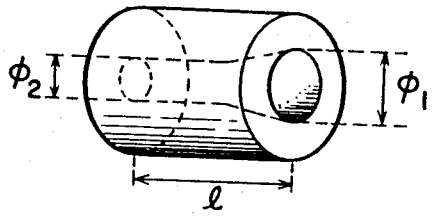
FIG. 4
FIG. 5A
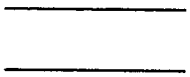
FIG. 5B
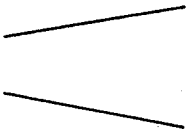
FIG. 5C
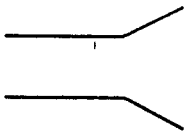
FIG. 5D
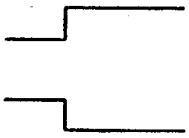
FIG. 5E
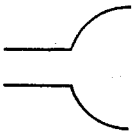
FIG. 5F
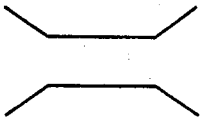
FIG. 5G
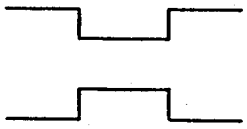

DEVICE FOR DECREASING SIDE STREAM SMOKE OF TOBACCO PRODUCTS

BACKGROUND OF THE INVENTION

This invention relates to a device for decreasing side stream smoke when smoking a cylindrical tobacco product typically a cigarette, a cigar or the like. Since cigarettes are most abundantly used, the device of this invention will be described in connection with the cigarette.

When smoking a cigarette, a primary smoke current inhaled by the smoker and a secondary or side stream smoke current generated at the burning point are produced. In a normal smoking condition (smokes for two seconds in one minute, and 35 ml of smoke is inhaled) the quantity of the side stream smoke is larger than that of the primary smoke current, and it has been noted that the quantity of injurious substances contained in the side stream smoke current is larger than that contained in the primary smoke current.

For example, in page 75 of Hirayama and Namiki's text book of the title "Smoking Medical Science" published by Kodansha, in Tokyo, the ratio of the injurious substances contained in the primary and side stream smoke currents is described as shown in the following table I.

TABLE I

| injurious substances | side stream smoke/primary smoke current |
|---|---|
| tar | 2.1–3.4 |
| nicotine | 1.8–2.8 |
| benzopypen | 3.9 |
| carbon monoxide | 4.7 |

In recent years the injuriousness of smoking has became a social problem. Of course, smoking is injurious to the smoker himself, but the injuriousness to nearby persons is mainly caused by the side stream smoke. However, no expedient has been made for preventing generation of the side stream smoke.

Contamination of air due to the side stream smoke can not simply be prevented by mere ventilation with surrounding air. A passive measures, no smoking times, no smoking cars and no smoking rooms are now being adopted.

Generally stating, smoke is produced by combustion of a substance at a burning point. When the substance burns, in some cases no smoke is generated, but invisible gas is generated. Combustion is generally defined as a chemical reaction occurring when a substance is oxidized. Among substances, there are substances containing oxygen and substances that do not burn unless oxygen is supplied thereto from outside. In the case of a cigarette, most of the oxygen necessary for the combustion is supplied from outside.

SUMMARY OF THE INVENTION

It is therefore an object of this invention to provide a novel device capable of minimizing generation of the side stream smoke.

Another object of this invention is to provide a device which, when fitted on a cigarette can prevent a fire hazard.

According to this invention, there is provided a device for preventing generation of side stream smoke from burning tobacco, comprising a main body made of a material not subject to burning by heat of the tobacco, the main body being formed with a longitudinal through hole for slidably accommodating the tobacco.

BRIEF DESCRIPTION OF THE DRAWINGS

In the accompanying drawings:

FIGS. 1A and 1B show a manner of use of the device of this invention for a cigarette;

FIGS. 2A to 2D show various configurations of the device of this invention;

FIG. 3 is a perspective view of one half of the present device constituted by combining two identical halves.

FIG. 4 is a perspective view of a modified embodiment of this invention;

FIGS. 5A to 5G show various configurations of the longitudinal sections of the device of this invention;

DESCRIPTION OF THE PREFERRED EMBODIMENTS

Figure 6:
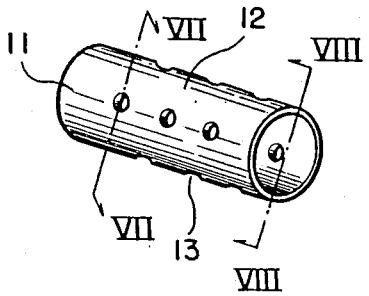
FIG. 6 is a perspective view showing a modified embodiment of the device of this invention.

The device of this invention is constructed to slidably cover a cigarette while maintaining a burning point in a through hole of the device, so as to continue combustion of the cigarette but decrease the generation of the side stream smoke. This principle is attributable to adjustment of the quantity of oxygen supplied to the burning point. Thus, when the burning point of the cigarette is covered by the device of this invention, it is advantageous to form a gap between the periphery of the cigarette and the inner surface of the through hole of the device sufficient to supply a quantity of oxygen necessary to maintain combustion. More particularly, when the outer periphery of the cigarette is strongly urged against the inner surface of the through hole of the device, the necessary quantity of oxygen would not be supplied to the burning point, whereby the combusion of fire is extinguished when inhalation ceases. On the other hand, when the gap is too large, the object of this invention could not be accomplished. For this reason, the relation between the diameter of the inner surface of the through hole and the diameter of the cigarette is important.

Experiments have been made on the effect of decreasing the side stream smoke and continuity of the combustion of the cigarette, by varying the diameter $\phi$ of the through hole when the length l thereof is 6 mm and 10 mm respectively, and the results are shown in the following table II.

TABLE II

| l | $\phi$ | side stream smoke | continuity of combustion of cigarette |
|---|---|---|---|
| 6 mm | size in which cigarette passes without wrinking its surface paper. | disappeared | fire was extinguished within one minute. |
| 6 mm | size in which cigarette passes without appreciably crimping its surface paper. | disappeared | fire was extinguished at about one minute. |
| 6 mm | about 1 mm larger than the diameter of cigarette. | disappeared | fire was extinguished about 1.2–1.5 |

TABLE II-continued

| l | $\phi$ | side stream smoke | continuity of combustion of cigarette |
|---|---|---|---|
| 10 mm | about 4 mm larger than the diameter of cigarette. | generated slightly. | minute. fire was extinguished at about 1.5–2 minute. |

It was found that as the diameter $\phi$ is increased the time of combustion of the cigarette increases and the effect of preventing the generation of the side stream smoke decreases. The result of the experiments showed that when the $\phi$ is about 1.5 times of the diameter of the cigarette, generation of the side stream smoke can be substantially reduced. Thus, by forming the diameter of the through opening in accordance with the diameter of the cigarette, the quantity of oxygen supply can be adjusted, thereby reducing the quantity of the side stream smoke while continuing combustion of the cigarette.

In a normal smoking state, since an inhalation is made once per minute, the results shown in Table II show that the device of this invention can be used as a smoking instrument.

As above described, the through hole is dimensioned to form a gap necessary to decrease the side stream smoke without extinguishing the combustion of the cigarette in short intervals between successive inhalations, so that the configuration of the gap is not required to be limited to a specific one. For example, the configuration of the inner surface of the through hole may be a circle, an ellipse, a square, a polygon or irregular, or combinations thereof.

The configuration of the device of this invention provided with the through hole is not limited to any specific configuration. For example, the device may be a cylinder or a cubic body. Examples of the longitudinal configurations of the through hole are shown in FIGS. 5A to 5G.

In FIG. 5A, the cross-sectional area of the through hole is constant over the length of the device. In FIGS. 5B, 5C, 5D and 5E the cross-sectional area of the through hole at the front side of the device is greater than that at the rear side of the device. In FIGS. 5F and 5G, the through hole area is greater at both the front and rear sides of the device than at an intermediate portion along the length of the device.

The diameter of the through hole is such that the cigarette can scarcely pass through the opening without wrinkling its surface paper, and the length of the through hole was set at 1, 2, 3, 6 and 9 mm respectively. Then smoking tests were conducted by inserting cigarettes in the through hole. As a result, it was found that so long as the burning point moves in the radial direction of the axis of the cigarette, no side stream smoke was generated for all lengths of the hole. However, the burning point is not always in the radial direction and it is desirable that the length of the through hole should be larger than 2 mm.

Then, a cylindrical device having different diameters $\phi_1$ and $\phi_2$ ($\phi_1 > \phi_2$) as shown in FIG. 4 was made and smoked with the larger diameter side matched with the burning point. As a result, was made confirmed that there was no side stream smoke and that the interval until the fire extinguishes (that is the interval of combustion of the cigarette) is longer than the case in which $\phi_1 = \phi_2$.

The material for making the device of this invention may be any material that does not burn with a flame when heated by the combustion heat of the cigarette. Thus, the device may be made of metals and plastics or may be a cylinder formed by wrapping a thin sheet of an inorganic paper or metal.

As shown in Table II, the device of this invention permits smoking without stopping the combustion between successive inhalations, but when the device is continuously disposed on an ash tray for more than two minutes without smoking, which is longer than a normal interval between successive inhalations, the combustion of the cigarette was completely stopped.

Usually, cigarettes are treated to adjust combustion time so that once they are lighted they can be enjoyed continuously. Accordingly, even when a lighted cigarette is left as it is without inhaling, the entire length of cigarette would burn out. Depending upon the type of the ash tray, the lighted cigarette often drops off the ash tray causing a fire hazard.

A statistical analysis shows that about 12% of the fire hazard in paper is caused by careless smokers, but with the device of this invention such hazard can be reduced greatly.

FIG. 1A shows a state of smoking in which the device 2 of this invention is at an intermediate point of a lighted cigarette 1. Under this state, a side stream smoke 4 is generated. FIG. 1B shows a state in which the device 2 is advanced to a position surrounding the lighted or burning point 3. In this state, no side stream smoke is generated. When enjoying smoking the device 2 may be removed from the cigarette 1.

Although the device 2 shown in FIGS. 1A and 1B is movable along the cigarette, the device of this invention may be secured to an ash tray, for example, in which case the burning point 3 of the cigarette is inserted into the stationary device before the next inhalation is made so as to prevent generation of the side stream smoke.

FIGS. 2A to 2D show examples of the device 2 of this invention each formed with a through hole. More particularly, FIG. 2A shows a cylindrical device 2 with a circular through hole 5, FIG. 2B a rectangular device with a hexagonal through opening, FIG. 2C a triangular device with an elliptical through hole, and FIG. 2D a cubical device formed with a hole having an irregular inner surface.

The through hole 5 of the device 2 can be formed when directly forming the device, but it also can be formed by combining two halves each of indentical configuration as shown in FIG. 3. To facilitate the manufacturing, the device 2 may be formed by combining a plurality of parts or by wrapping a thin sheet into a cylinder. When the device is made of a non-burning and heat conductive material, as the device is moved along the cigarette the fingers of the user may be burnt so that it is desirable to provide a handle or cooling fins for the device.

As above described, the device of this invention can prevent or reduce generation of the side stream smoke with a simple construction and can prevent fire hazard.

As a result of experiments, it has been found that where the cross-sectional area of the through hole is made to be $\pi r^2 mm^2 \sim \pi(r+2)^2 mm^2$ (where r represents the radius of the cigarette) and when the length of the hole is made to be longer than 1 mm, the generation of the side stream smoke can be minimized. When the length of the through hole is longer than 1 mm, a cross-sectional area of $\pi r^2 mm^2 \sim \pi(r+2)^2 mm^2$ is sufficient at a point spaced at least 1 mm from one end of the device.

In this invention, the length of the through hole is important. To determine the minimum value of the through hole, various experiments showed that when the burning surface is perpendicular to the axis of the cigarette, so no secondary smoke current was generated even when the length of the through hole is only 1 mm. However, in most cases, the burning surface inclines more or less with reference to the axis of the cigarette, it is advantageous that the length of the through hole should be larger than 2 mm.

When the cross-sectional area of the through hole is equal to $\pi r^2 mm^2$, the efficiency of interception of oxygen is large thus minimizing the generation of the side stream smoke.

When the cross-sectional area is less than $\pi r^2 mm^2$, supply of oxygen is completely intercepted to extinguish the fire. According to an international smoking condition, inhalation is made once (two seconds) per one minute and 35 ml of smoke is inhaled at each time, this condition being an average value of numerous smokers. Accordingly, the device of this invention has no practical value unless it can satisfy a condition that the fire would not extinguish over a period of longer than one minute. To ensure continuous burning, it is necessary to increase the quantity of exygen supplied to the burning point covered by the device over that when the hole cross-sectional area is equal to $\pi r^2 mm^2$. To increase the quantity of oxygen supply, grooves may be formed on the inner surface of the hole or small openings may be formed through the wall of the device. The problem can be solved by a simple measure of making the cross-sectional area of the through hole to be larger than $\pi r^2 mm^2$. As the cross-sectional area is gradually increased, a small quantity of the side stream smoke will be generated. The measured radius of the through opening at this time was (r+2)mm. Consequently, the upper limit of the cross-sectional area that can prevent generation of the side stream smoke must be $\pi(r+2)^2 mm^2$. When the device of this invention having the dimensions just described was mounted on a lighted cigarette, a time of 1.2–2.0 minutes elapsed between the mounting of the device on the burning point and extinguishment of the fire.

The essential condition of this invention lies in the size of the cross-sectional area of the through hole in relation to the cross-sectional area of the cigarette and in the fact it will not be substantially influenced by the cross-sectional configuration.

When the cross-sectional area of the through hole, is close to the upper limit $\pi(r+2)^2 mm^2$, the stability is improved when the cigarette is positioned at the center of the hole. For this purpose the cross-sectional configuration of the through hole is shaped polygonal for directly supporting the cigarette. Alternatively, a plurality of radially extending projections are formed for supporting the cigarette by the inner ends of the projections.

The generation of the side stream smoke can be prevented or greatly reduced by mounting the device described above on the cigarette for covering the burning point 3 of the cigarette, so as to control the quantity of oxygen supplied from outside which is necessary to continue combustion. In this case a balance should be maintained between suppression of the side stream smoke and continuous combustion of the cigarette. Accordingly, when the device is mounted on the cigarette such that the burning point will be positioned to the outer or front end of the device the time in which the combustion continues becomes the longest, whereas when the burning point is positioned on the inner side of the front end of the device, the quantity of the secondary smoke current can be reduced but the time in which the combustion can be continued would be decreased.

In the following embodiment the devices are improved such that the generation of the side stream smoke can be efficiently reduced and that the continuous combustion time can be elongated even when the combustion point is positioned at any point along the through hole of the device. In other words, it is not necessary to take care the point of burning when mounting the device on the cigarette. More particularly, according to the improved device, the sectional area of the through hole is made to be $\pi r^2 mm^2 \sim \pi(r+2)^2$ and one or more perforations or slots are formed through the wall defining the through hole.

These perforations or slots function to adjust the quantity of oxygen supplied into the through hole thereby prolonging the combustion time and substantially preventing generation of the side stream smoke without being affected by the position of the burning point along the through hole.

The number, size and distribution of the perforations or the slots must be determined by taking into consideration the length and diameter of the through hole. In this embodiment, the ratio between the entire peripheral area A of the hole and the total area B of the perforations or slots constitutes an important factor that governs the quantity of oxygen supplied from outside. In this modification, the ratio B/A is made to be in a range of 5 and 15% when the cross-sectional area of the through hole lies in a range of from $\pi r^2 mm^2$ to $\pi(r+2)^2 mm^2$. With less than 5% of the ratio B/A, it is impossible to supply a quantity of oxygen sufficient to prolong the combustion time, whereas when the ratio exceeds 15% the quantity of oxygen supplied becomes excessive to lose the inherent object of suppressing the generation of the side stream smoke.

When the ratio B/A lies in the range of from 5% to 15%, the effect of this invention is governed by the diameter $\phi$ and the size of the perforations. For example, by making $\phi = 1.8$ mm, the relation between $\phi$ and the reduction (in percentage) in the generation of the side stream smoke was measured and the results are shown in the following table III.

TABLE III

| diameter of perforation (mm) | percentage of reduction of side stream smoke |
|---|---|
| 9 | 90 |
| 10 | 70 |
| 11 | 40 |

The configuration of the perforation may be circular, elliptical, triangular or irregular. The direction of the slot may be perpendicular or inclined with respect to the axis of the through hole. It will be clear that both perforations and slots can be formed.

The length of the device of this invention must be at least 2 mm, but for convenience of use a length of 10 mm or longer is preferred. If desired the length of the device may be equal to that of a cigarette.

Figure 7:
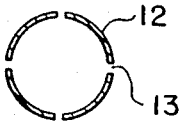
FIG. 7 is a cross-sectional view taken along a line VII—VII in FIG. 6.
Figure 8:
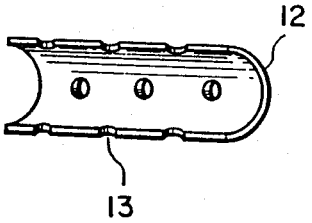
FIG. 8 is a sectional view taken along a line VIII—VIII in FIG. 6.

As shown in FIGS. 6, 7, and 8, the modified device 11 takes the form of a cylinder 12 provided with four rows of perforations each extending in the longitudinal direction, each row including three performations 13.

Figure 9:
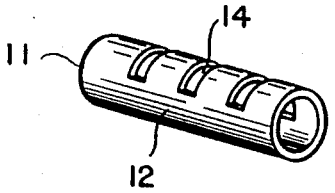
FIG. 9 is a perspective view showing still another modification of this invention.

In still another modification shown in FIG. 9, the device 11 is provided with three slots 14 spaced in the longitudinal direction.

These modified embodiments having cylindrical through holes are also used in the same manner as that shown in FIG. 1A. In these modifications where the quantity of the oxygen supplied to the front end of the device is deficient, the oxygen is supplemented by the perforations or slots so as to maintain combustion.

Modified devices shown in FIGS. 6 and 9 can be made of the same material as that described in connection with the first embodiment shown in FIGS. 1A and 1B and their construction may be the same as those shown in FIGS. 2A to 2D.

What is claimed is:

1. A device for decreasing generation of side stream smoke from a burning, generally cylindrical tobacco product, comprising:

a main body made of material which is non-combustible in the presence of heat generated by burning tobacco, said main body being formed with a longitudinal through hole for slidably accommodating the outer periphery of said tobacco product;

wherein said through hole has a cross-sectional area in the range of about $\pi r^2 mm^2$ to $\pi(r+2)^2 mm^2$, where r equals the radius of the tobacco product in millimeters;

said main body has a plurality of openings spaced from one another in the longitudinal direction and extending between the outer periphery of said main body and the inner surface of said through hole; and the ratio between the total area of said openings and the total inner surface of said through hole is selected in the range of about 5 to 15%.

2. The device according to claim 1 wherein said plurality of openings extend perpendicular to an axis of said tobacco product.

3. The device according to claim 1 wherein said plurality of openings are slots inclined with respect to an axis of said tobacco product.

4. The device according to claim 1 wherein said through hole is selected with a circular, elliptical or polygonal cross-sectional configuration.

5. The device according to claim 1 wherein diameter of said through hole is larger at one side of said main body than at the other side.

* * * * *